US012152868B2

(12) United States Patent
Shin et al.

(10) Patent No.: US 12,152,868 B2
(45) Date of Patent: Nov. 26, 2024

(54) DEVICE AND METHOD THEREOF FOR OPERATING STEMMING ROD USED FOR BLASTING AND CONFIGURED TO INCLUDE INFORMATION COLLECTION FUNCTION

(71) Applicant: HANWHA CORPORATION, Seoul (KR)

(72) Inventors: Tae Seob Shin, Yongin-si (KR); Se Ho Kim, Cheongju-si (KR); Jeong Ho Choi, Cheongju-si (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 18/008,748

(22) PCT Filed: Oct. 7, 2022

(86) PCT No.: PCT/KR2022/015151
§ 371 (c)(1),
(2) Date: Dec. 7, 2022

(87) PCT Pub. No.: WO2023/128160
PCT Pub. Date: Jul. 6, 2023

(65) Prior Publication Data

US 2024/0230301 A1 Jul. 11, 2024

(30) Foreign Application Priority Data

Dec. 29, 2021 (KR) ..... 10-2021-0190500

(51) Int. Cl.
*F42D 1/08* (2006.01)
*F42D 1/00* (2006.01)
(Continued)

(52) U.S. Cl.
CPC ..... *F42D 1/08* (2013.01); *F42D 1/00* (2013.01); *F42D 1/045* (2013.01); *F42D 1/05* (2013.01);
(Continued)

(58) Field of Classification Search
CPC ... F42D 1/145; F42D 1/05; F42D 1/08; F42D 1/14; F42D 1/16; F42D 3/04; F42D 1/045; F42D 1/00; F42D 1/055; F42D 1/06
See application file for complete search history.

(56) References Cited

U.S. PATENT DOCUMENTS 10,267,611 B2 * 4/2019 Lownds ..... F42D 5/00
2005/0103219 A1 5/2005 McClure et al.
(Continued)

FOREIGN PATENT DOCUMENTS

CN 209991879 U 1/2020
WO 00/36364 A1 6/2000
(Continued)

*Primary Examiner* — James S Bergin
(74) *Attorney, Agent, or Firm* — WHDA, LLP

(57) ABSTRACT

A device and a method thereof for operating a stemming rod used for the blasting and configured to include an information collection function are proposed. The device includes a stemming material information collection unit configured to collect stemming material information including information related to energy applied and compaction counts when filling a stemming material into a blast hole, from a sensor built into the stemming rod used for the blasting, a communication-performing unit configured to perform wireless communication with a detonator to be charged through a communication module built into the stemming rod used for the blasting, and a blasting time controller configured to control a blasting time on the basis of detonator information and location information of the stemming rod used for the
(Continued)

blasting, the information being collected from the communication-performing unit.

4 Claims, 2 Drawing Sheets

(51) Int. Cl.

| | |
|---|---|
| ***F42D 1/04*** | (2006.01) |
| ***F42D 1/045*** | (2006.01) |
| ***F42D 1/05*** | (2006.01) |
| ***F42D 1/055*** | (2006.01) |
| ***F42D 1/06*** | (2006.01) |
| ***F42D 3/04*** | (2006.01) |

(52) U.S. Cl.
CPC ..... *F42D 1/055* (2013.01); *F42D 1/06* (2013.01); *F42D 3/04* (2013.01)

(56) References Cited

U.S. PATENT DOCUMENTS

| | | | | |
|---|---|---|---|---|
| 2006/0272536 | A1 | 12/2006 | Lownds et al. | |
| 2021/0333077 | A1* | 10/2021 | Kuk | H04W 56/00 |
| 2021/0333078 | A1* | 10/2021 | Hwang | G08C 17/02 |

FOREIGN PATENT DOCUMENTS

| | | | |
|---|---|---|---|
| WO | 2008/055274 | A1 | 5/2008 |
| WO | 2012/149277 | A2 | 11/2012 |

* cited by examiner

DEVICE AND METHOD THEREOF FOR OPERATING STEMMING ROD USED FOR BLASTING AND CONFIGURED TO INCLUDE INFORMATION COLLECTION FUNCTION

TECHNICAL FIELD

The present disclosure relates to a device and a method thereof for operating a stemming rod used for blasting and configured to include an information collection function and, more particularly, to a device and a method thereof for operating a stemming rod used for blasting and configured to include an information collection function, wherein functions of information collection and communication are assigned to the stemming rod, which serves to compact a stemming material of a blast hole or to push and transfer an explosive to an end of the blast hole.

BACKGROUND ART

Recently, the demand for blasting methods in downtown areas is increasing, and the use of the blasting methods of tunnel and excavation in areas adjacent to security objects are becoming more frequent. Accordingly, research on a micro-vibration blasting method is being actively conducted. Such a blasting method is in progress with a series of work processes, such as drilling, gunpowder loading, stemming, wiring, and blasting.

Here, stemming refers to a process of blocking a blast hole's entrance, which is an open part of a blast hole, with a specific material to prevent expansion pressure caused by detonation of gunpowder from being released to the open part of the blast hole, and a process of concentrating the blasting force completely on the blast hole to promote efficient rock crushing.

However, in the conventional stemming work method, since it is difficult to evaluate stemming quality of each worker performing the stemming work, defective stemming quality may not be recognized, so blasting pressure is ejected through the blast hole during blasting, whereby there are problems that efficiency of crushing rock is impaired, a vibration level at an ejection point is increased, and so on.

In this regard, Korean Patent No. 1413292 discloses "RAPID STEMMING MATERIAL USED IN SHORT BOREHOLE FOR CONCRETE STRUCTURE DEMOLITION AND BLASTING DEMOLITION METHOD USING THE SAME)".

DISCLOSURE

Technical Problem

The present disclosure is devised to solve the above problems, and an objective of the present disclosure is to provide a device and a method thereof for operating a stemming rod used for blasting and configured to include an information collection function for collecting stemming material information including information related to energy applied and compaction counts when filling a stemming material into a blast hole, from a sensor built into the stemming rod used for the blasting.

In addition, another objective of the present disclosure is to provide a device and a method thereof for operating a stemming rod used for the blasting and configured to include an information collection function, wherein the device and the method are configured to control a blasting time on the basis of location information of the stemming rod used for the blasting and detonator information, the location information and the detonator information being collected by performing wireless communication with a detonator to be charged through a communication module built into the stemming rod used for the blasting.

Technical Solution

According to the present disclosure for achieving the above objectives, there is provided a device for operating a stemming rod used for blasting and configured to include an information collection function, the device including: a stemming material information collection unit configured to collect stemming material information including information related to energy applied and compaction counts when filling a stemming material into a blast hole, from a sensor built into the stemming rod used for the blasting; a communication-performing unit configured to perform wireless communication with a detonator to be charged through a communication module built into the stemming rod used for the blasting; and a blasting time controller configured to control a blasting time on the basis of detonator information and location information of the stemming rod used for the blasting, the information being collected from the communication-performing unit.

In addition, the device may further include a stemming-defective blast hole determination unit configured to determine a stemming-defective blast hole by comparing the stemming material information collected in real time and the normal stemming material information that is derived on the basis of a result of analyzing information related to the energy applied and the compaction counts when filling the stemming material and previously collected through the stemming material information collection unit.

In addition, the communication-performing unit may transmit the location information of the stemming rod used for the blasting to the detonator, and receive the detonator information including detonation time-in-milliseconds information, blast delay time information, identifier information, and location information.

In addition, the blasting time controller may determine a location of the blast hole on the basis of the collected location information of the stemming rod used for the blasting, and control the blasting time by reflecting a blasting time in milliseconds that is assigned by matching the detonator information according to the determined location of the blast hole.

According to the present disclosure for achieving the above objectives, there is provided a method for operating a stemming rod used for blasting and configured to include an information collection function, the method including: collecting, by a stemming material information collection unit, stemming material information including information related to energy applied and compaction counts when filling a stemming material into a blast hole, from a sensor built into the stemming rod used for the blasting; performing, by a communication-performing unit, wireless communication with a detonator to be charged through a communication module built into the stemming rod used for the blasting; and controlling, by a blasting time controller, a blasting time on the basis of detonator information and location information of the stemming rod used for the blasting, the information being collected from the communication-performing unit.

In addition, the method may further include, after the collecting of the stemming material information, including the information related to the energy applied and the compaction counts when filling the stemming material into the blast hole, from the sensor built into the stemming rod used for the blasting, determining a stemming-defective blast hole by comparing the stemming material information collected in real time and the normal stemming material information that is derived on the basis of a result of analyzing information related to the energy applied and the compaction counts when filling the stemming material and previously collected.

In addition, in the performing of the wireless communication with the detonator to be charged through the communication module built into the stemming rod used for the blasting, the location information of the stemming rod used for the blasting may be transmitted to the detonator, and the detonator information including detonation time-in-milliseconds information, blast delay time information, identifier information, and location information may be received.

In addition, in the controlling of the blasting time on the basis of the detonator information and the location information of the stemming rod used for the blasting, the information being collected from the communication-performing unit, the location of the blast hole may be determined on the basis of the collected location information of the stemming rod used for the blasting, and the blasting time may be controlled by reflecting a blasting time in milliseconds that is assigned by matching the detonator information according to the determined location of the blast hole.

Advantageous Effects

The present disclosure relates to a device and a method thereof for operating a stemming rod used for the blasting and configured to include an information collection function, and there is an effect that stemming material information collected in real time is compared with the normal stemming material information derived on the basis of a result obtained by analyzing stemming material information related to the energy applied and the compaction counts when filling the stemming material into the blast hole, from the sensor built in the stemming rod used for the blasting, whereby before the blasting, a stemming-defective blast hole may be determined, and also a personnel who do the defective stemming work may be guided. That is, the present disclosure may increase the blasting efficiency by improving the stemming quality.

In addition, in the present disclosure, there is an effect that the location of the blast hole is determined on the basis of the location information of the stemming rod used for the blasting, the location information being collected through the communication module built into the stemming rod used for the blasting, and the blasting time is controlled by reflecting the blasting time in milliseconds assigned by matching the detonator information according to the determined location of the blast hole, whereby a follow-up time may be shortened and the automation for assigning the blasting time in milliseconds may be realized.

BEST MODE

Figure 1:
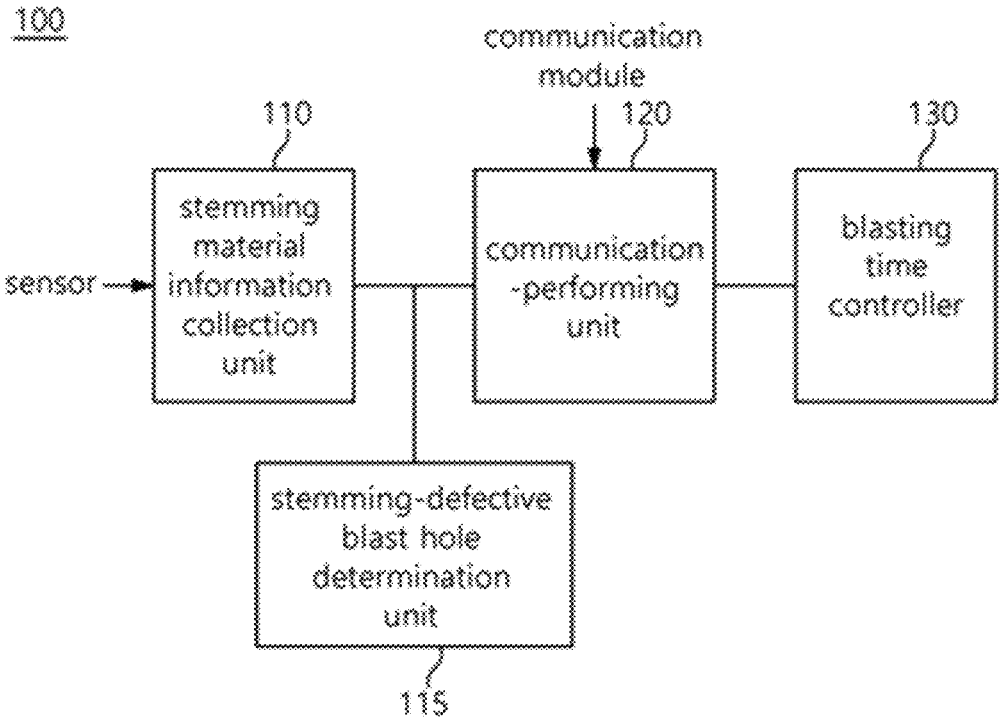
FIG. 1 is a view illustrating a configuration of a device for operating a stemming rod used for blasting and configured to include an information collection function according to the present disclosure.

In the present disclosure, various modifications may be made and various exemplary embodiments may be provided, and specific exemplary embodiments will be illustrated in the drawings and described in detail.

However, this is not intended to limit the present disclosure to a particular disclosed form. On the contrary, the present disclosure is to be understood to include all various alternatives, equivalents, and substitutes that may be included within the idea and technical scope of the present disclosure. While describing each drawing, similar reference numerals have been used for similar components.

When a component is described as being "connected", "coupled", or "linked" to another component, that component may be directly connected, coupled, or linked to that other component. However, it should be understood that yet another component between each of the components may be present. In contrast, it should be understood that when a component is referred to as being "directly coupled" or "directly connected" to another component, there are no intervening components present.

The terminology used herein is for the purpose of describing particular exemplary embodiments only and is not intended to be limiting. As used herein, the singular forms are intended to include the plural forms as well, unless the context clearly indicates otherwise. In addition, it will be further understood that the terms "comprise", "include", "have", etc. when used in the present application, specify the presence of stated features, integers, steps, operations, elements, components, and/or combinations of them but do not preclude the possibility of the presence or addition of one or more other features, integers, steps, operations, elements, components, and/or combinations thereof.

Hereinafter, preferred exemplary embodiments of the present disclosure will be described in more detail with reference to the accompanying drawings. Hereinafter, the same reference numerals are used for the same components in the drawings, and duplicate descriptions for the same components are omitted.

FIG. 1 is a view illustrating a configuration of a device for operating a stemming rod used for blasting and configured to include an information collection function according to the present disclosure.

Describing with reference to FIG. 1, the device 100 for operating the stemming rod used for the blasting and configured to include the information collection function according to the present disclosure includes a stemming material information collection unit 110, a stemming-defective blast hole determination unit 115, a communication-performing unit 120, and a blasting time controller 130.

The stemming material information collection unit 110 collects stemming material information including information related to energy applied and compaction counts when filling a stemming material in a blast hole, from a sensor built into the stemming rod used for the blasting. Here, the stemming material refers to a material such as clay or sand for stemming the blast hole after loading an explosive into the blast hole. When the blast hole is sealed with the stemming material, the power of the explosive is sufficiently exhibited, thereby improving a blasting effect. In this case, the type of the stemming material is clay, sand, stone powder, water, etc., and among these materials, common materials used are the sand, stone powder, and clay. Meanwhile, the energy applied herein refers to a force converted from a pressure measured by a worker performing stemming work.

The stemming-defective blast hole determination unit 115 determines a stemming-defective blast hole by comparing stemming material information collected in real time and the normal stemming material information that is derived on the basis of a result of analyzing information related to the energy applied and the compaction counts when filling the stemming material and previously collected through the stemming material information collection unit 110.

The communication-performing unit 120 performs wireless communication with a detonator to be charged through a communication module built in the stemming rod used for the blasting. Here, the communication module may be a transceiver and an antenna such as RFID/NFC/other wireless communication, but is not limited thereto.

The communication-performing unit 120 may transmit location information of a stemming rod used for the blasting to a detonator, and receive detonator information including detonation time-in-milliseconds information, blast delay time information, identifier information, and location information.

The blasting time controller 130 controls a blasting time on the basis of the location information of the stemming rod used for the blasting and the detonator information, the information being collected from the communication-performing unit 120.

The blasting time controller 130 may determine a location of a blast hole on the basis of the collected location information of the stemming rod used for the blasting, and may control a blasting time by reflecting a blasting time in milliseconds that is assigned by matching the detonator information according to the determined location of the blast hole.

Figure 2:
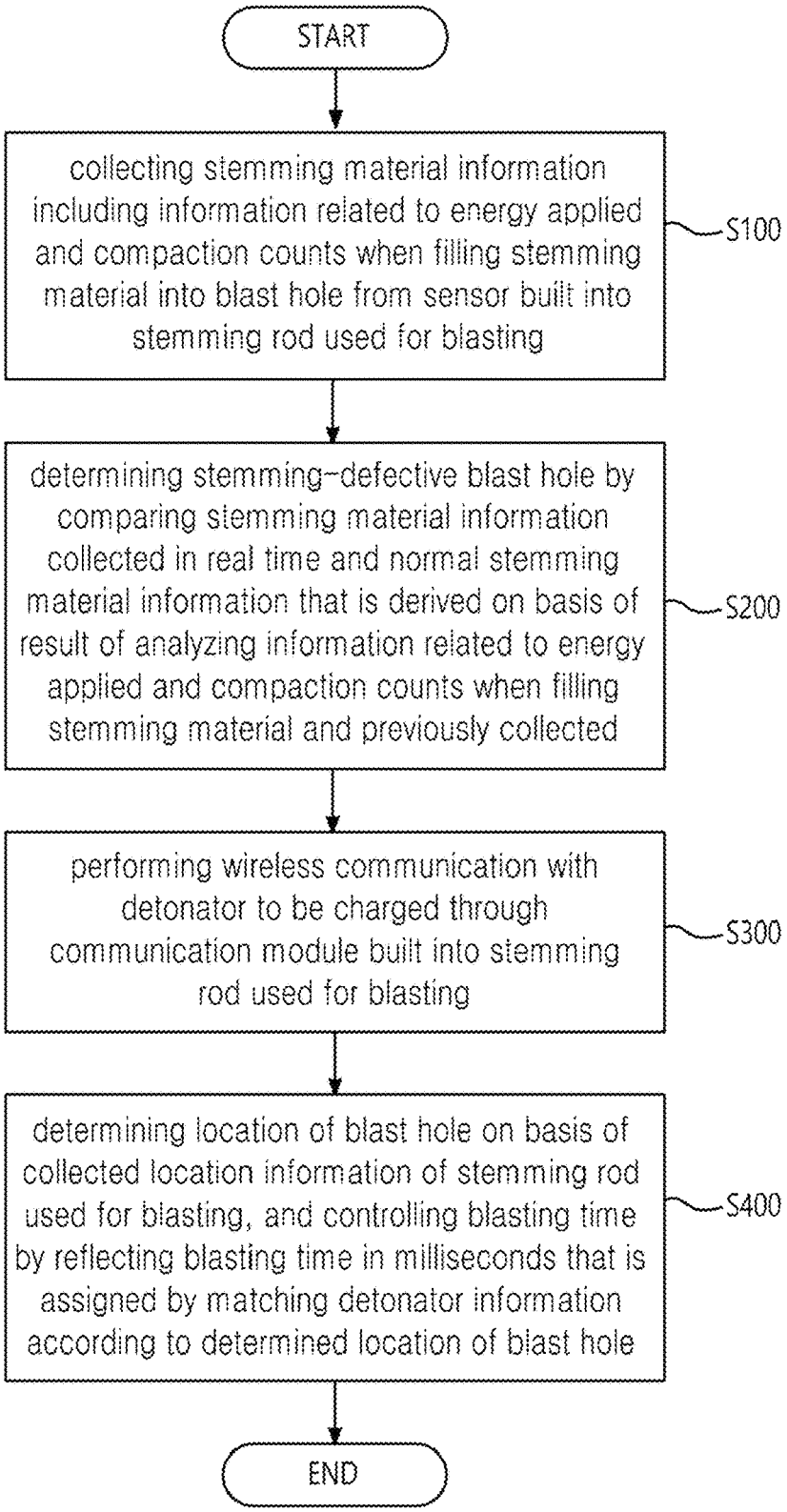
FIG. 2 is a view illustrating a sequence of a method for operating a stemming rod used for blasting and configured to include an information collection function according to the present disclosure.

FIG. 2 is a view illustrating a sequence of a method for operating a stemming rod used for the blasting and configured to include an information collection function according to the present disclosure.

Describing with reference to FIG. 2, the method for operating the stemming rod used for the blasting and configured to include the information collection function according to the present disclosure is a method of using the device for operating the stemming rod used for the blasting and configured to include the information collection function according to the present disclosure described above, and redundant descriptions will be omitted below.

First, in step S100, stemming material information including information related to energy applied and compaction counts when filling a stemming material is collected from a sensor built into the stemming rod used for the blasting.

Next, in step S200, a stemming-defective blast hole is determined by comparing stemming material information collected in real time and the normal stemming material information that is derived on the basis of a result of analyzing the information related to the energy applied and the compaction counts when filling the stemming material and previously collected.

Next, in step S300, wireless communication is performed with a detonator to be charged through a communication module built into the stemming rod used for the blasting.

In step S300, the communication module may be a transceiver and an antenna such as RFID/NFC/other wireless communication, and in step S300, location information of the stemming rod used for the blasting may be transmitted to the detonator, and detonator information including detonation time-in-milliseconds information, blast delay time information, identifier information, and location information may be received.

Next, in step S400, the blasting time is controlled on the basis of the location information of the stemming rod used for the blasting and the detonator information, the information being collected in step S300.

In step S400, the location of the blast hole may be determined on the basis of the collected location information of the stemming rod used for the blasting, and the blasting time may be controlled by reflecting the blasting time in milliseconds that is assigned by matching the detonator information according to the determined location of the blast hole.

As described above, the functional operation and the embodiments related to the present subject matter, which are described in the present specification, may be implemented in a digital electronic circuit or computer software, firmware, hardware, or a combination of one or more thereof, including the structures and structural equivalents thereof, which are disclosed herein.

The embodiments of the subject matter described herein may be implemented as one or more computer program products, i.e., one or more modules related to computer program instructions encoded on a tangible program medium for execution by or for controlling the operation of a data processing device. The tangible program medium may be a radio wave signal or a computer-readable medium. The radio wave signal is a signal generated to encode information for transmission to an appropriate receiver device for execution by a computer, that is, for example, an artificially generated signal such as a machine-generated electrical, optical, or electromagnetic signal. The computer-readable medium may be a machine-readable storage device, a machine-readable storage substrate, a memory device, a combination of materials that affect a machine-readable radio wave signal, or a combination of one or more thereof.

Additionally, the logic flows and structural block diagrams described in the present patent document are intended to describe corresponding functions supported by the disclosed structural means and corresponding actions and/or specific methods supported by the disclosed steps, and may also be used to implement corresponding software structures and algorithms and their equivalents.

In addition, the present description presents the best mode of the present disclosure, and provides examples for describing the present disclosure and for enabling those skilled in the art to make and use the present disclosure. The specification written in this way is not intended to limit the present disclosure to the specific terms presented.

Accordingly, although the present disclosure has been described in detail with reference to the above-described examples, those skilled in the art can make modifications, changes, and deformation to the present examples without departing from the scope of the present disclosure. In short, in order to achieve the intended effect of the present disclosure, it is not necessary to separately include all the functional blocks shown in the drawings or follow all the orders shown in the drawings. It should be noted that even though all the functional blocks are separately included or all the orders shown in the drawings are followed as they are shown, the corresponding functional blocks and orders may fall within the technical scope of the present invention described in the claims.

The invention claimed is:

1. A device for operating a stemming rod used for blasting and configured to include an information collection function, the device comprising:

a stemming material information collection unit configured to collect stemming material information comprising energy applied and compaction counts when filling a stemming material into a blast hole, from a sensor built into the stemming rod used for the blasting;

a communication-performing unit configured to perform wireless communication with a detonator to be charged through a communication module built into the stemming rod used for the blasting;

a blasting time controller configured to control a blasting time on the basis of detonator information and location information of the stemming rod used for the blasting, the information being collected from the communication-performing unit; and a stemming-defective blast hole determination unit configured to determine a stemming-defective blast hole by comparing the stemming material information collected in real time and the normal stemming material information that is derived on the basis of a result of analyzing information related to the energy applied and the compaction counts when filling the stemming material and previously collected through the stemming material information collection unit, wherein the blasting time controller determines a location of the blast hole on the basis of the collected location information of the stemming rod used for the blasting, and controls the blasting time by reflecting a blasting time in milliseconds that is assigned by matching the detonator information according to the determined location of the blast hole, and wherein the sensor is any sensor that converts pressure and force transferred to the stemming rod to produce a signal that is measured and counted.

2. The device of claim 1, wherein the communication-performing unit transmits the location information of the stemming rod used for the blasting to the detonator, and receives the detonator information comprising detonation time-in-milliseconds information, blast delay time information, identifier information, and location information.

3. A method for operating a stemming rod used for blasting and configured to include an information collection function, the method comprising:

collecting, by a stemming material information collection unit, stemming material information comprising energy applied and compaction counts when filling a stemming material into a blast hole, from a sensor built into the stemming rod used for the blasting;

performing, by a communication-performing unit, wireless communication with a detonator to be charged through a communication module built into the stemming rod used for the blasting;

controlling, by a blasting time controller, a blasting time on the basis of detonator information and location information of the stemming rod used for the blasting, the information being collected from the communication-performing unit; and after the collecting of the stemming material information, comprising the information related to the energy applied and the compaction counts when filling the stemming material into the blast hole, from the sensor built into the stemming rod used for the blasting, determining a stemming-defective blast hole by comparing the stemming material information collected in real time and the normal stemming material information that is derived on the basis of a result of analyzing information related to the energy applied and the compaction counts when filling the stemming material and previously collected, wherein, in the controlling of the blasting time on the basis of the detonator information and the location information of the stemming rod used for the blasting, the information being collected from the communication-performing unit, the location of the blast hole is determined on the basis of the collected location information of the stemming rod used for the blasting, and the blasting time is controlled by reflecting a blasting time in milliseconds that is assigned by matching the detonator information according to the determined location of the blast hole, and wherein the sensor is any sensor that converts pressure and force transferred to the stemming rod to produce a signal that is measured and counted.

4. The method of claim 3, wherein, in the performing of the wireless communication with the detonator to be charged through the communication module built into the stemming rod used for the blasting, the location information of the stemming rod used for the blasting is transmitted to the detonator, and the detonator information comprising detonation time-in-milliseconds information, blast delay time information, identifier information, and location information is received.

* * * * *